US007460077B2

(12) United States Patent
Hemmi et al.

(10) Patent No.: US 7,460,077 B2
(45) Date of Patent: Dec. 2, 2008

(54) POLARIZATION CONTROL SYSTEM AND METHOD FOR AN ANTENNA ARRAY

(75) Inventors: Christian O. Hemmi, Plano, TX (US); James S. Mason, Richardson, TX (US)

(73) Assignee: Raytheon Company, Waltham, MA (US)

( * ) Notice: Subject to any disclaimer, the term of this patent is extended or adjusted under 35 U.S.C. 154(b) by 13 days.

(21) Appl. No.: 11/614,761

(22) Filed: Dec. 21, 2006

(65) Prior Publication Data

US 2008/0150799 A1 Jun. 26, 2008

(51) Int. Cl.
*H01Q 21/00* (2006.01)

(52) U.S. Cl. ..... 343/725; 343/754; 343/770; 343/853

(58) Field of Classification Search ..... 343/725, 343/754, 770, 853; 342/372, 373
See application file for complete search history.

(56) References Cited

U.S. PATENT DOCUMENTS

| | | | | | |
|---|---|---|---|---|---|
| 3,836,976 | A | | 9/1974 | Monser et al. | 343/795 |
| 5,038,150 | A | * | 8/1991 | Bains | 342/373 |
| 5,276,452 | A | | 1/1994 | Schuss et al. | 342/371 |
| 5,461,392 | A | * | 10/1995 | Mott et al. | 343/725 |
| 5,557,291 | A | * | 9/1996 | Chu et al. | 343/725 |
| 5,760,740 | A | | 6/1998 | Blodgett | 342/362 |
| 5,966,102 | A | | 10/1999 | Runyon | 343/820 |
| 6,144,339 | A | | 11/2000 | Matsumoto et al. | 342/361 |
| 6,166,701 | A | | 12/2000 | Park et al. | 343/771 |
| 6,262,690 | B1 | | 7/2001 | Malone et al. | 343/850 |
| 6,377,558 | B1 | * | 4/2002 | Dent | 370/321 |
| 6,583,760 | B2 | * | 6/2003 | Martek et al. | 342/373 |
| 6,864,837 | B2 | * | 3/2005 | Runyon et al. | 342/372 |
| 7,138,952 | B2 | | 11/2006 | McGrath et al. | 343/751 |

FOREIGN PATENT DOCUMENTS

| | | |
|---|---|---|
| EP | 0 917 240 A1 | 5/1999 |
| EP | 1 679 764 A1 | 7/2006 |
| WO | WO 99/36992 | 7/1999 |

OTHER PUBLICATIONS

PCT; International Search Report and Written Opinion; (IS/EP) for PCT/US2007/086477 (14 pages), Mar. 31, 2008.

* cited by examiner

*Primary Examiner*—Hoang V Nguyen
(74) *Attorney, Agent, or Firm*—Baker Botts L.L.P.

(57) ABSTRACT

In one embodiment, a polarization control system for an antenna array comprises a number of first and second antenna elements and a beam forming network. The first antenna elements have a direction of polarization that is different from a direction of polarization of the second antenna elements. The beam forming network, which is coupled to the first and second antenna elements, is operable to provide a second signal to a first subset of the plurality of first antenna elements that is different from a first signal that is provided to the other first antenna elements and provide a third signal to a second subset of the second antenna elements that is different from the first signal that is provided to the other second antenna elements.

23 Claims, 5 Drawing Sheets

POLARIZATION CONTROL SYSTEM AND METHOD FOR AN ANTENNA ARRAY

TECHNICAL FIELD OF THE DISCLOSURE

This disclosure relates generally to antenna arrays, and more particularly, to a polarization control system for an antenna array and a method of adjusting the same.

BACKGROUND OF THE DISCLOSURE

Microwave communications includes transmission and receipt of electro-magnetic energy that extends from the short wave frequencies to the near infrared frequencies. In order to utilize electro-magnetic energy at these frequencies, a number of differing types of antennas have been developed. Due to the relatively strong polarization characteristics of electro-magnetic energy at these frequencies, antenna systems have been developed that are capable of controlling the beam polarization of the electro-magnetic wave. Additionally, antenna systems having elliptical or circular polarizations have been developed to overcome several propagation limitations inherent in these strongly polarized waveforms.

SUMMARY OF THE DISCLOSURE

In one embodiment, a polarization control system for an antenna array comprises a number of first and second antenna elements and a beam forming network. The first antenna elements have a direction of polarization that is different from a direction of polarization of the second antenna elements. The beam forming network is coupled to the first and second antenna elements. The beam forming network is operable to provide a second signal to a first subset of the plurality of first antenna elements that is different from a first signal that is provided to the other first antenna elements. The beam forming network is also operable to provide a third signal to a second subset of the second antenna elements that is different from the first signal that is provided to the other second antenna elements.

In another embodiment, a method for adjusting a beam polarization of an antenna array comprises providing a number of first and second antenna elements, attenuating an amplitude of an electro-magnetic wave produced by the plurality of first antenna elements by adjusting the amplitude of a first subset of the plurality of the first antenna elements, and producing an electro-magnetic wave by the plurality of first and second antenna elements by adjusting the phase shift of a second subset of the plurality of the second antenna elements. The first antenna elements have a direction of polarization that is different from a direction of polarization of the second antenna elements such that an electro-magnetic wave produced by the plurality of first and second antenna elements generally approximates the beam polarization.

Some embodiments of the present disclosure may provide numerous technical advantages. A technical advantage of one embodiment may be a polarization control system for an antenna array that uses relatively inexpensive control circuitry to manipulate the resulting electro-magnetic wave to any beam polarization. The teachings of the present disclosure make use of the fact that precise control of a microwave signal may be obtained by combining the component electro-magnetic waves produced by a multiple quantity of antennas. In this manner, control circuitry may be used having significantly less complexity and costs than known polarization control systems.

Although specific advantages have been disclosed hereinabove, it will be understood that various embodiments may include all, some, or none of the disclosed advantages. Additionally, other technical advantages not specifically cited may become apparent to one of ordinary skill in the art following review of the ensuing drawings and their associated detailed description

BRIEF DESCRIPTION OF THE DRAWINGS

A more complete understanding of various embodiments will be apparent from the detailed description taken in conjunction with the accompanying drawings in which.

DETAILED DESCRIPTION OF EXAMPLE EMBODIMENTS

Figure 1:
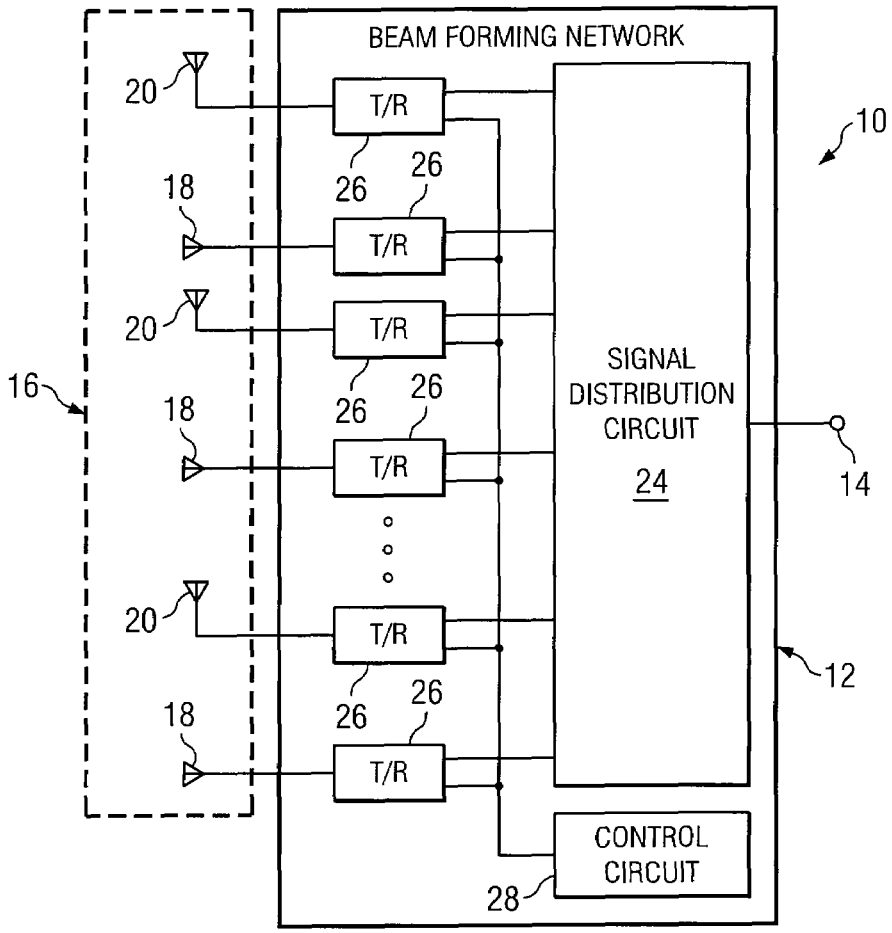
FIG. 1 is a diagram view of one embodiment of a polarization control system.

Example embodiments of the disclosure now will be described more fully below with reference to the accompanying drawings, in which several embodiments are shown. Reference numerals used throughout this document refer to like elements in the drawings.

FIG. 1 shows one embodiment of a polarization control system 10 according to one embodiment of the present disclosure. The polarization control system 10 generally comprises a beam forming network 12 that couples a signal input line 14 to an antenna array 16. Antenna array 16 has multiple horizontal antenna elements 18 and multiple vertical antenna elements 20. The term "horizontal antenna elements" may refer to a number of antenna elements having a similar polarity. The term "vertical antenna elements" may refer to a number of antenna elements having a similar polarity and the polarity of the "vertical antenna elements" is different from the polarity of the "horizontal antenna elements."

In operation, the horizontal antenna elements 18 may work in conjunction to form a locus of electro-magnetic waves having a horizontal polarity, and the vertical antenna elements 20 may work in conjunction to form a locus of electro-magnetic waves having a vertical polarity. In one embodiment, the horizontal 18 and vertical 20 antenna elements may have any frequency of operation that has a relatively strong polarization characteristic, such as those frequencies in the micro-wave range. Given this characteristic, the beam forming network 12 may be operable to accept a signal from the signal input line 14 and provide one or more signals to each of the horizontal 18 and vertical 20 antenna elements in such a manner that an electro-magnetic wave emanating therefrom has any desirable beam polarization. That is, the beam forming network 12 may be operable to individually control each antenna element 18 and 20 such that a locus of electro-magnetic waves emanating therefrom produces a resultant electro-magnetic wave having any desired beam polarization.

Beam forming network 12 may include a signal distribution circuit 24, a plurality of transmit/receive modules 26, and a control circuit 28. The signal distribution circuit 24 may be provided to distribute a signal from the signal input line 14 to each of the transmit/receive modules 26. Each of the transmit/receive modules 26 may be coupled to each one or a subset of the horizontal 18, or vertical 20 antenna elements. Thus, the horizontal 18 and vertical 20 antenna elements are coupled to the signal input line 14 through its associated transmit/receive module 26 and the signal distribution circuit 24. In one embodiment, each of the transmit/receive modules 26 may be operable to modify a signal from the signal distribution circuit 24 into another signal having an attenuated amplitude or a delayed phase shift. Control circuit 28 is operable to control the output amplitude and phase shift of each of the transmit/receive modules 26. In this manner, individual horizontal 18 or vertical 20 antenna elements may be independently modified in order to manipulate the beam polarization of the resulting electro-magnetic wave emanating from the horizontal 18 and vertical 20 antenna elements.

As will be described in greater detail below, control of the beam polarization of the resulting electro-magnetic wave may be provided by modifying a signal to a subset of the horizontal antenna elements 18 relative to the other plurality of horizontal antenna elements 18 and modifying the signal to a subset of the vertical antenna elements 18 relative to the other plurality of vertical antenna elements 20. That is, a signal may be provided to a subset of horizontal antenna elements 18 that is different than the other plurality of horizontal antenna elements 18 in order to proportionally modify the resulting electro-magnetic waveform produced by the horizontal antenna elements 18. The resulting electro-magnetic wave from vertical antenna elements 20 may be proportionally controlled in a similar manner.

Certain embodiments may provide advantage in that independent control over particular subsets of the horizontal 18 and vertical 20 antenna elements may allow greater resolution of the resulting beam polarization produced by the antenna array 16 for a given resolution capability provided by transmit/receive modules 26. That is, usage of the antenna array 16 according to the present disclosure may allow the usage of transmit/receive modules 26 having a relatively lower resolution capability in order to achieve comparable beam polarization resolution with conventional antenna arrays with transmit/receive modules having greater resolution capability.

Conventional antenna arrays may typically require transmit/receive modules having 4 to 6 bits of resolution, whereas transmit/receive modules 26 implemented according to the present disclosure may only require 1 to 3 bits of resolution in order to provide comparable beam polarization resolution. Bit resolution may be referred to as an amount of fractional gradient that a proportional system may vary and may be expressed as:

$$\text{bit resolution}=2^{(\textit{quantity of bits})}$$

For example, a particular transmit/receive module having 3 bits of resolution may have $2^3$ or 8 proportional values that an outputted signal may have. It is known that production costs of these transmit/receive modules 26 are directly proportional to their bit resolution, therefore certain embodiments may provide advantage in that relative costs to produce an antenna array 16 having a particular beam polarization resolution may be less expensive using the teachings of the present disclosure.

Figure 2:
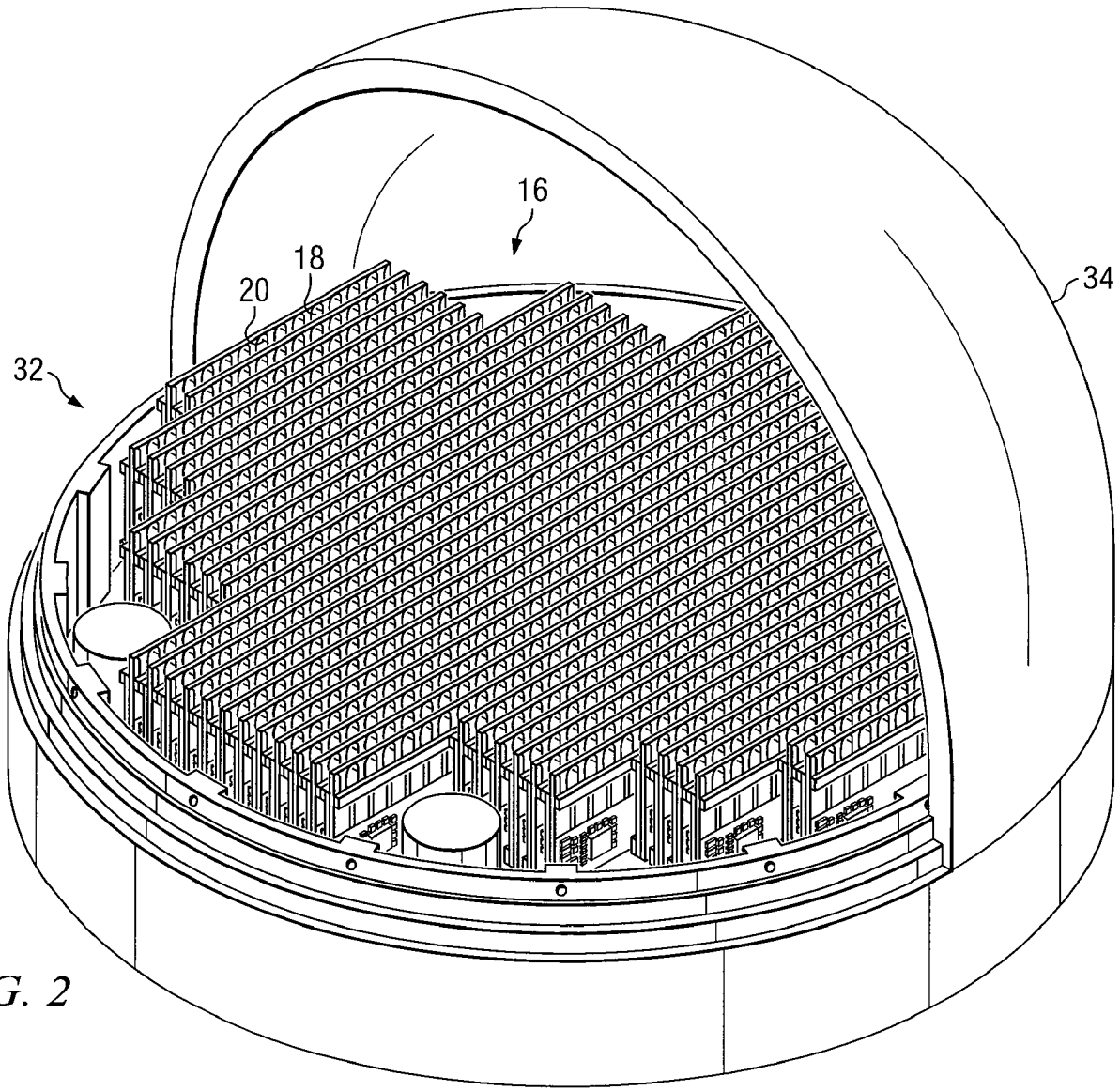
FIG. 2 is a perspective view of an antenna housing in which a portion of a radome has been cut away to reveal an antenna array that may be used with the embodiment of FIG. 1.

FIG. 2 shows one embodiment of the antenna array 16 that may be implemented in a housing 32. As shown, the antenna array 16 has a number of horizontal 18 and vertical 20 elements that are contiguously arranged in a generally planar fashion. In order to provide protection of the antenna array 16 from adverse environmental effects, a radome 34 may be provided.

Figure 3:
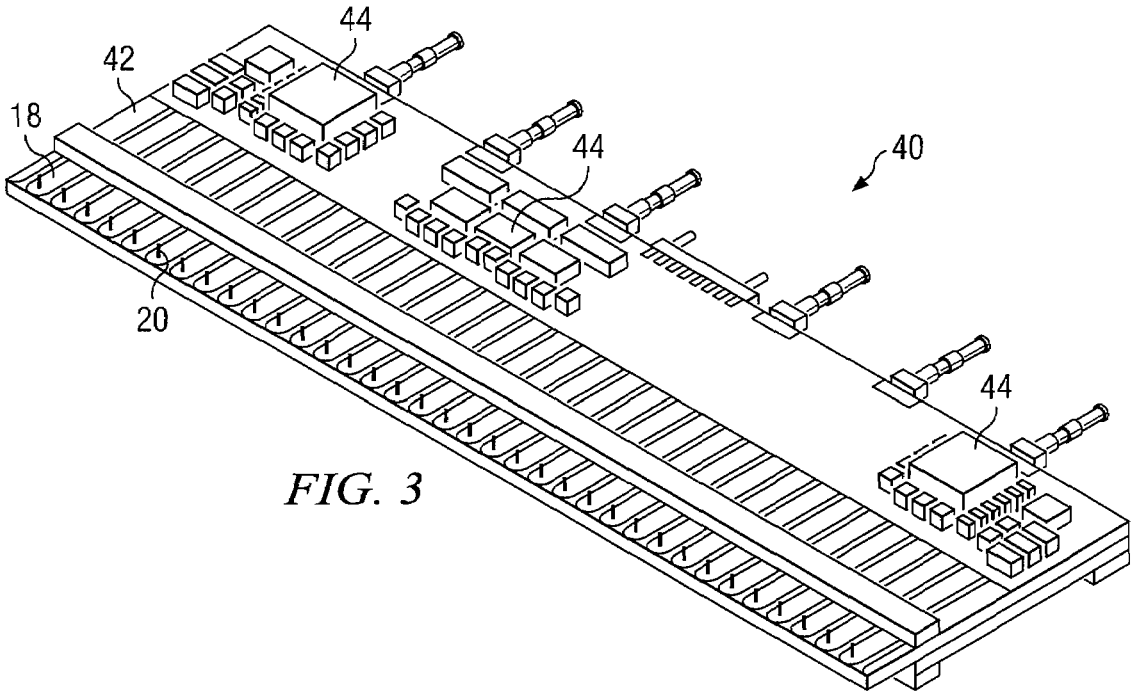
FIG. 3 is a perspective view of one embodiment of a circuit card having a number of horizontal and vertical antenna elements that may form a portion of the antenna array of FIG. 2.

FIG. 3 shows a circuit card 40 that may have a number of horizontal 18 and vertical 20 antenna elements formed thereon. The antenna array 16 as shown in FIG. 2 may be fashioned from a number of circuit cards 40 stacked one beside each other. The circuit card 40 is shown having multiple horizontal 18 and vertical 20 antenna elements that may be configured to form one row of the antenna array 16. Circuit card 40 has several horizontal antenna elements 18 that may be flared notch radiators. These flared notch radiators are etched into an edge portion of the circuit card 40. Extending from each horizontal antenna element 18 is a vertical antenna element 20 that may be a monopole radiator. Also included on the circuit card 40 is a spacer 42 that may be a rectangular shaped metallic member. Also included are several electrical components 44 that serve to form signal distribution circuit 24, transmit/receive modules 27, and/or control circuit 28. Multiple circuit cards 40 may be stacked, one upon another, in order to form the antenna array 16 as shown in FIG. 2.

Figure 4:
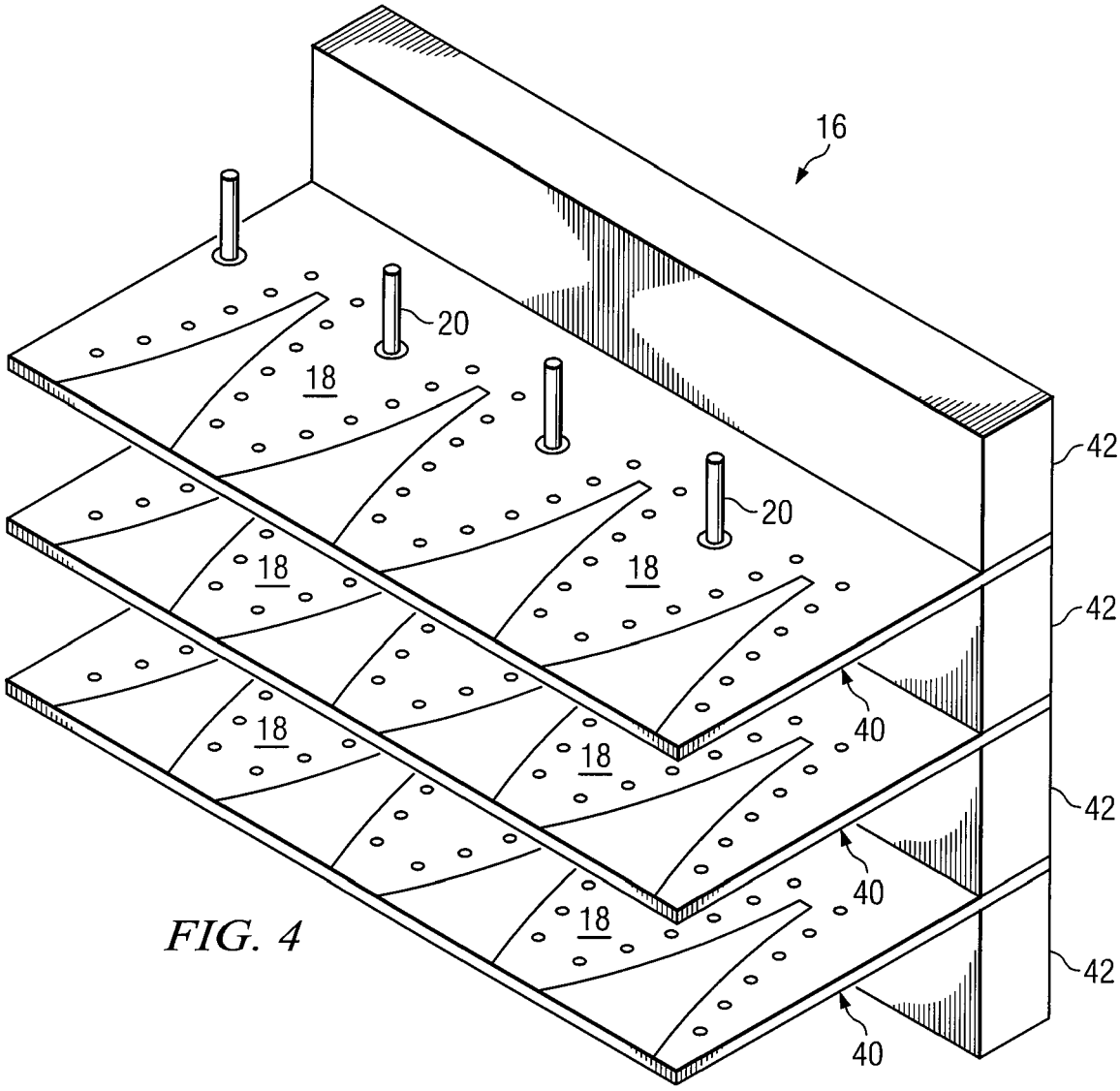
FIG. 4 is an enlarged partial perspective view of the antenna array of FIG. 2.

FIG. 4 shows a portion of several circuit cards 40 that form the antenna array 16 of FIG. 2. In this particular embodiment, each of the horizontal 18 and vertical 20 antenna elements are interleaved with respect to one another. Each horizontal antenna element 18, represented in this embodiment, by a flared notch radiator is paired with a vertical antenna element 20, represented by a monopole radiator. In such a pairing, each vertical antenna element 20 is shown centered between a corresponding horizontal antenna element 18 to form an interleaving of the antenna array 16. Although such a configuration is shown in this embodiment, it should be understood that other configurations can be utilized in other embodiments of the disclosure. In this embodiment, the monopole radiators are vertically polarized while the flared notch radiators are horizontally polarized. Thus, the direction of the polarization of the monopole radiators may be orthogonal to the direction of the polarization of the flared notch radiators. In addition to separating each of the circuit boards 40, the spacers 42 may serve as reflection surfaces for the vertical antenna elements 20.

The horizontal antenna elements 18 shown in the drawings are a type of notch radiator commonly referred to as a flared notch radiator. However, any type of antenna element capable of radiating electro-magnetic energy at the desired frequency of operation may be used with the teachings of the present disclosure. Additionally, although the vertical antenna elements 20 are monopole radiators, any suitable antenna element capable of radiating electro-magnetic energy at a beam polarization angle different from the horizontal antenna elements 18 may be used.

When excited simultaneously, the electric and magnetic fields produced by each antenna element 18 and 20 combine in free space in order to form a resulting waveform that is the product of the electric and magnetic field vector components of each electro-magnetic waveform. For example, when two horizontal antenna elements 18 are excited by a similar signal, the resulting waveform radiated into free space possesses a similar phase angle having an amplitude that is twice that of the waveform produced by a single antenna element 18. When a horizontal 18 and vertical 20 antenna element are each excited by signals that are in phase relative to one another, a resulting electro-magnetic wave may be produced that has a polarization angle of approximately 45 degrees. In one embodiment, the beam forming network 12 may be operable to provide several differing signals to varying subsets of each of the array of horizontal 18 and/or vertical 20 antenna elements in such a manner that an electro-magnetic wave emanating therefrom has any desirable beam polarization. A subset may be referred to as any quantity of a particular antenna element type that is a portion of the total quantity of antenna elements of that particular type. For example, if the antenna array 16 has a total quantity of 672 vertical antenna elements 20, a subset of the vertical antenna elements may be any quantity from 1 to 681 vertical antenna elements 20.

Figure 5A:
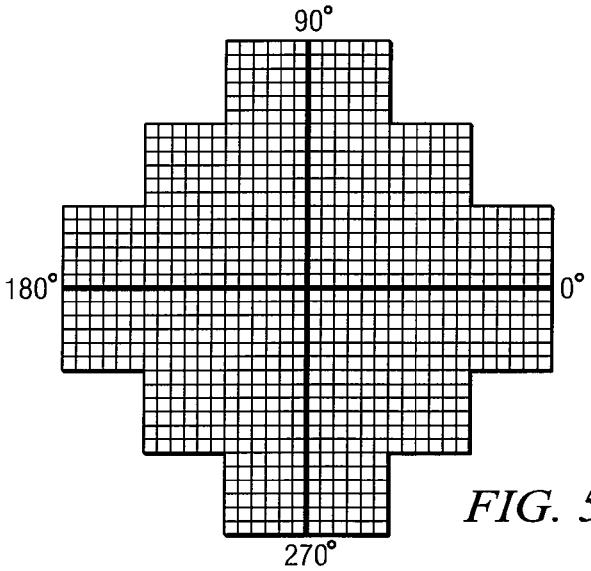
FIG. 5A is an array of blocks representing a plan view of the antenna array of FIG. 2.

FIG. 5A shows an array of blocks representing a plan view of the array of horizontal 18 and vertical 20 elements of FIG. 2. Each block represents one horizontal 18 and vertical 20 antenna element. As shown in this particular embodiment, the antenna array 16 has a total quantity of 672 horizontal antenna elements 18 and 672 vertical antenna elements 20. For purposes of description, the antenna array 16 is aligned along a radial coordinate system such that the horizontal antenna elements 18 may emit electro-magnetic waves having a electric field that propagate from the array along the 0 to 180 degree axis. The vertical antenna elements 20 also may emit electro-magnetic waves having an electric field that propagates from the array along the 90 to 270 degree axis. Thus, in order to create an electro-magnetic wave having a horizontal polarization, a signal may be applied to the horizontal antenna elements 18 while turning off the signal from the vertical antenna elements 20. A vertically polarized electro-magnetic wave may be produced by the antenna array 10 in a similar manner by turning off the horizontal antenna elements 18 and exciting the vertical antenna elements 20. A circularly polarized wave may be created by exciting both the horizontal and vertical elements with 90 degree or 270 degree phase difference.

In one embodiment, an electro-magnetic wave may be produced having virtually any angular phase shift or beam polarization by antenna array 16. Modifying the phase shift of the resultant wave may be accomplished by adjusting the amplitude or phase shift of a subset of each of the horizontal 18 or vertical 20 antenna elements. That is, a subset of the total quantity of horizontal 18 or vertical 20 antenna elements may be excited by a differing signal than is applied to the other horizontal 18 or vertical 20 antenna elements respectively. This differing signal may be obtained by modification of an incoming signal from the signal input line 14. The differing signal may be created by each of the transmit/receive modules 26. In one embodiment, each of the transmit/receive modules 26 may be operable to provide a differing signal that varies according to amplitude and/or phase shift. In another embodiment, each transmit/receive module 26 may include a three-bit phase shifting circuit that is operable to manipulate the phase shift of the differing signal in increments of, for example, 45 degrees. In another embodiment, each transmit/receive module 26 may include a one-bit amplitude controlling circuit that is operable to manipulate the differing signal from an "off" state to an "on" state. As will be described in detail below, certain embodiments may provide a polarization control system 10 that requires transmit/receive modules 26 having only three-bits phase resolution and one-bit of amplitude resolution.

In another embodiment, a scan angle of the resultant electro-magnetic wave may be accomplished by adjusting the phase shift of a subset of each of the horizontal 18 or vertical 20 antenna elements. Thus, the scan angle of the resulting electro-magnetic wave may be manipulated by adding suitable phase shifts to phase shifts of a subset of each of the horizontal 18 or vertical 20 antenna elements used to manipulate its beam polarization. A scan angle is generally referred to as the angular offset of an electro-magnetic wave from the boresight axis of the antenna array 16. Manipulation of the scan angle may also serve to control side lobes developed by the antenna array 16 during operation.

Figure 5B:
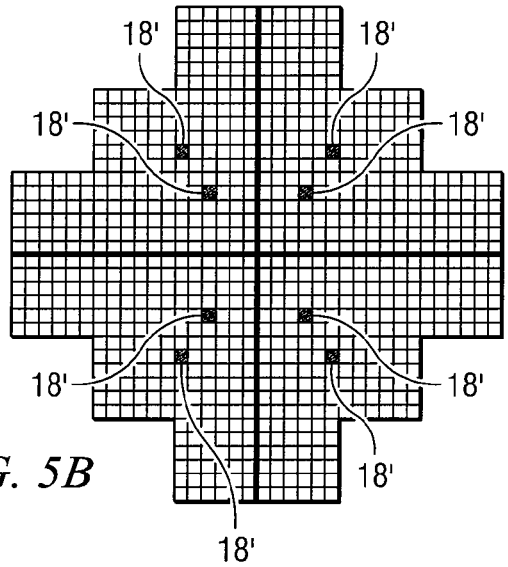
FIG. 5B is an array of blocks representing a plan view of the antenna array of FIG. 2, wherein several blocks are shaded to indicate several corresponding antenna elements that have an attenuated signal.

FIG. 5B shows an array of blocks representing a plan view of the array of horizontal 18 and vertical 20 elements of FIG. 2. In the example provided by this view, all of the horizontal antenna elements 18 are in the "on" state and have a 0 degree phase shift with the exception of four horizontal antenna elements indicated by shaded blocks 18'. Additionally, in this example, the vertical antenna elements 20 are in the "off" state such that the resulting electro-magnetic wave produced by the antenna array 16 has a horizontal polarization. Out of a total quantity of 672 horizontal antenna elements 18, eight horizontal antenna elements 18' are in the "off" state. Thus, the resulting electro-magnetic wave produced by the antenna array is attenuated by the factor of 664/672 or 0.988. Any subset of the horizontal antenna elements 18 may be turned off in a similar manner in order to effectively attenuate the resulting electro-magnetic wave produced by the horizontal antenna elements 18. Although the previous example describes proportional attenuation of the electro-magnetic wave produced by the horizontal antenna elements 18, the electro-magnetic wave produced by the vertical antenna elements 20 may also be proportionally attenuated in a similar manner.

Figure 5C:
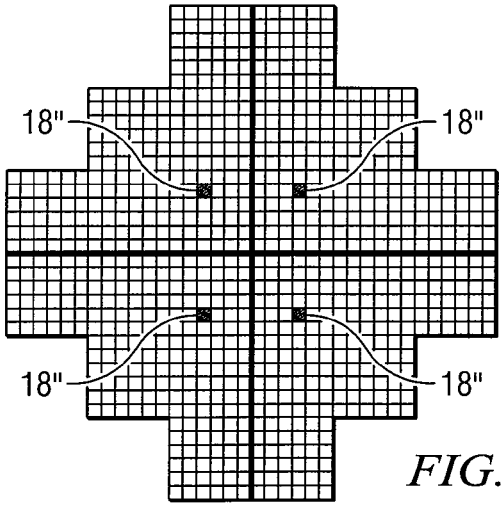
FIG. 5C is an array of blocks representing a plan view of the antenna array of FIG. 2, wherein several blocks are shaded to indicate several corresponding antenna elements that have a phase shifted signal.

FIG. 5C shows an array of blocks representing a plan view of the array of horizontal 18 and vertical 20 elements of FIG. 2. In this particular example, all of the horizontal antenna elements 18 with the exception of four horizontal antenna elements indicated by shaded blocks 18" are in the "on" state and have a 0 degree phase shift. The shaded blocks however, indicate four horizontal antenna elements that are in the "on" state and have a signal with phase shift of 45 degrees applied thereto. Additionally, all vertical antenna elements 20 are in the "off" state. Thus, the resulting electro-magnetic wave produced by the antenna array 16 may have a phase shift of approximately 4/672*45 degrees. That is, when the horizontal antenna elements 18 are excited by the two differing signals, the resulting electro-magnetic wave produced by the antenna array 16 may have a phase shift of approximately 0.268 degrees. Thus, it may be seen that the effective phase shift of a resulting electro-magnetic wave may be proportionally controlled using transmit/receive modules 26 having only three-bits of phase shift resolution. Although the previous example describes proportional phase shifting of the electro-magnetic wave produced by the horizontal antenna elements 18, the electro-magnetic wave of the vertical antenna elements 20 may also be proportionally phase shifted in a similar manner.

In one aspect of the present disclosure, attenuation and phase shifting of individual elements of each antenna type may be combined in order to effectively modify the beam polarization of the antenna array 16. The antenna type may be either the horizontal 18 or vertical 20 antenna element. In one embodiment, adjustment of the attenuation and phase shift of subsets of horizontal 18 and vertical 20 antenna elements may be applied in a manner such that an elliptical or circular polarized electro-magnetic wave is produced by the antenna array 16.

Figure 6:
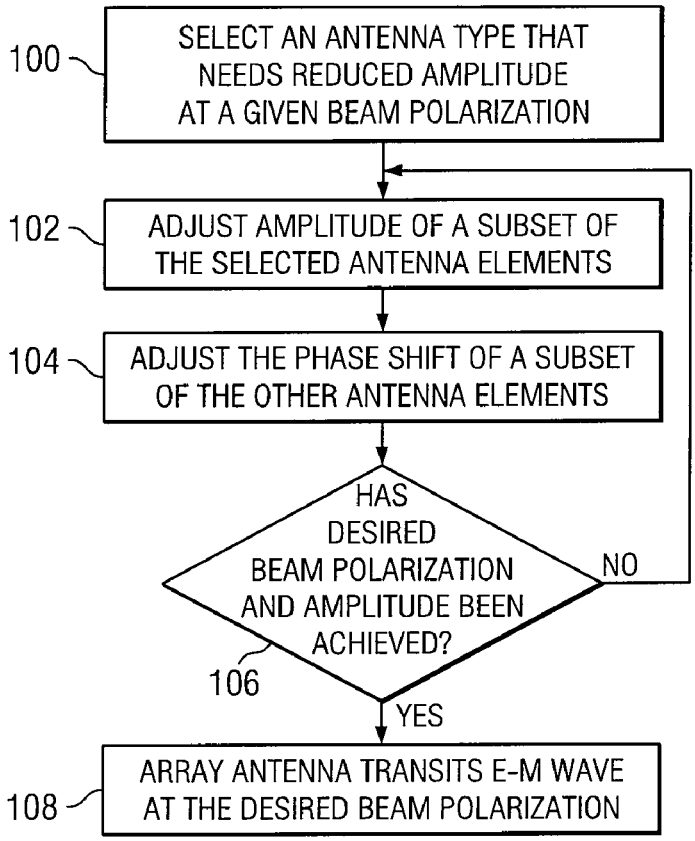
FIG. 6 is a flowchart depicting a sequence of acts that may be performed in order to adjust a beam polarization of an electro-magnetic waveform that is produced by the embodiment of FIG. 1.

FIG. 6 shows a sequence of acts that may be performed in order to adjust the attenuation and phase shift of a subset of each of the horizontal 18 and vertical 20 antenna elements. In act 100, a particular antenna element type is selected that need reduced amplitude to produce a desired beam polarization. The particular antenna type may be either horizontal or vertical antenna elements. The selected element type may be chosen based upon a number of factors. In one embodiment, the amplitude of a particular element type may be chosen for attenuation such that a circular polarized wave resulting therefrom may provide reasonable symmetry throughout a full rotation of the waveform. Next in act 102, the selected element type may be attenuated by adjusting the amplitude of a subset of the total number of antenna elements 18 or 20 that were selected in act 100. In one embodiment, the amplitude may be adjusted such that the subset of antenna elements 18 or 20 are turned to the "off" state. In another embodiment, the amplitude of the subset of antenna elements 18 or 20 may be adjusted in increments using a proportional attenuator such as a three-bit attenuator.

In act 104, the phase shift of a subset of the other non-selected antenna elements 18 or 20 may be adjusted such that the overall electro-magnetic wave produced by the antenna array 16 approximates the desired beam polarization. In some embodiments, acts 102 and 104 may produce an electro-magnetic wave having sufficient beam polarization accuracy and amplitude accuracy. If so, adjustment of the antenna array 16 is complete and the antenna array transmits the electro-magnetic wave at the desired operating parameters, act 108. However, acts 102 and 104 may be performed again if further adjustment of the resultant waveform is desired as indicated at act 106.

The previously described method may be used to create an elliptical or circular polarized electro-magnetic wave having relatively accurate symmetry. However usage of the adjustment method of FIG. 6 may produce undesirable side lobe patterns. In one embodiment, a remedy for these side lobe patterns may be to provide a predetermined attenuation factor for particular elements within the antenna array 16. In another embodiment, a predetermined attenuation factor may be applied to a number of segments of antenna elements 18 and 20.

Figure 7:
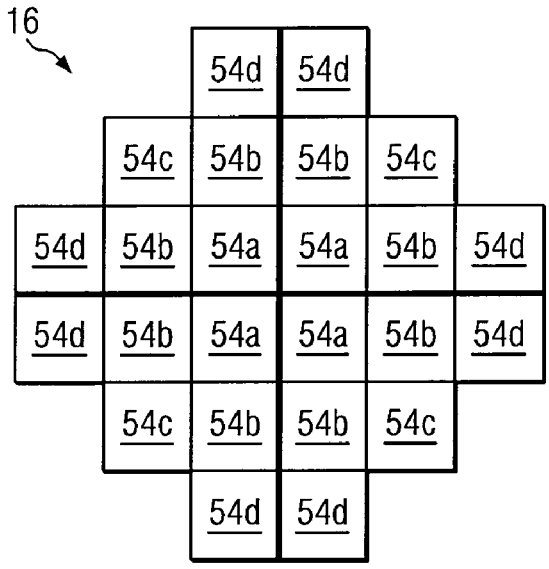
FIG. 7 is a plan view of the antenna array of FIG. 2 showing another embodiment wherein the amplitude of several antenna elements may taper from a central region to an outer perimeter of the antenna array.

FIG. 7 shows the antenna array 16 of FIG. 2 where the plurality of antenna elements 18 and 20 have been delineated into a number of segments 54. Each of the segments 54 may include a subset of antenna elements 18 and 20. In this particular embodiment, each segment 54 has a quantity of thirty-six horizontal 18 and vertical 20 antenna elements arranged in a six-by-six configuration.

Each segment 54 within the antenna array 16 is provided with a predetermined attenuation factor such that the amplitude provided to each antenna element 18 or 20 tapers from the central portion to the outer perimeter of the antenna array 16. Thus, segments 54*a* have a predetermined attenuation factor that may be approximately 0. That is, segments 54*a* may be provided with a signal having effectively no predetermined attenuation. Segments 54*b* have an predetermined attenuation factor that may be approximately 0.394. Segments 54*c* have an predetermined attenuation factor that may be approximately 0.558. Segments 54*d* have a predetermined attenuation factor that may be approximately 0.609. The previously cited attenuation factor values are normalized to 1.

The previous example describes one way of providing a predetermined tapering amplitude to an antenna array 16; however, it should be understood that the amplitude of individual antenna elements 18 or 20 may be provided with a predetermined tapering factor from the central portion to the outer perimeter using other known approaches. Thus, antenna elements 18 and 20 proximate the central portion of the antenna array 16 may produce an electro-magnetic waveform having a greater amplitude than antenna elements in segments 54*c* and 54*d*. In operation, the predetermined attenuation factors may be weighted with attenuation values provided by each transmit/receive module 26. In this manner, an electro-magnetic wave produced by the antenna array 16 may have improved side lobe control and improved symmetry.

It will be apparent that many modifications and variations may be made to embodiments of the present disclosure, as set forth above, without departing substantially from the principles of the present disclosure. Therefore, all such modifications and variations are intended to be included herein within the scope of the present disclosure, as defined in the claims that follow.

What is claimed is:

1. A polarization control system for an antenna array comprising:

a plurality of first antenna elements comprising flared notch antenna elements having a generally horizontal direction of polarization;

a plurality of second antenna elements comprising monopole antenna elements having a generally vertical direction of polarization, the horizontal direction of polarization being substantially orthogonal to the vertical direction of polarization, the plurality of first and second antenna elements are contiguously arranged in a generally planar fashion, the first and second antenna elements having a predetermined amplitude weighting factor that tapers from a central region to an outer perimeter of the plurality of first and second antenna elements; and a beam forming network coupled to the plurality of first and second antenna elements and operable to:

attenuate only an amplitude of a first subset of the plurality of first antenna elements, wherein the amplitude is either off or on; and shift a phase of a second subset of the plurality of second antenna elements.

2. The polarization control system of claim 1, wherein the phase varies in increments of not less than 45 degrees.

3. A polarization control system for an antenna array comprising:

a plurality of first antenna elements comprising flared notch antenna elements having a generally horizontal direction of polarization;

a plurality of second antenna elements comprising monopole antenna elements having a generally vertical direction of polarization, the horizontal direction of polarization being substantially orthogonal to the vertical direction of polarization, the plurality of first and second antenna elements are contiguously arranged in a generally planar fashion, the first and second antenna elements having a predetermined amplitude weighting factor that tapers from a central region to an outer perimeter of the plurality of first and second antenna elements; and a beam forming network coupled to the plurality of first and second antenna elements and operable to:

attenuate only an amplitude of a first subset of the plurality of first antenna elements, and shift a phase of a second subset of the plurality of second antenna elements, wherein the phase varies in increments of not less than 45 degrees.

4. The polarization control system of claim 3, wherein the amplitude is either off or on.

5. A polarization control system for an antenna array comprising:

a plurality of first antenna elements having a first direction of polarization;

a plurality of second antenna elements having a second direction of polarization, the second direction of polarization being different than the first direction of polarization; and a beam forming network coupled to the plurality of first and second antenna elements and operable to:

provide a second signal to a first subset of the plurality of first antenna elements that is different from a first signal that is provided to the other plurality of first antenna elements; and provide a third signal to a second subset of the plurality of second antenna elements that is different from the first signal that is provided to the other plurality of second antenna elements.

6. The polarization control system of claim 5, wherein the second or third signal differs from the first signal by amplitude.

7. The polarization control system of claim 6, wherein the second or third signal differs from the first signal essentially only by amplitude.

8. The polarization control system of claim 6, wherein the amplitude of the second or third signal is either off or on.

9. The polarization control system of claim 6, wherein the amplitude of the second or third signal varies with less than or equal to three bits of resolution.

10. The polarization control system of claim 5, wherein the second or third signal differs from the first signal by phase.

11. The polarization control system of claim 10, wherein the second or third signal differs from the first signal only by phase.

12. The polarization control system of claim 10, wherein the phase of the second or third signal varies in increments of not less than 45 degrees.

13. The polarization control system of claim 5, wherein the first direction of polarization is orthogonal to the second direction of polarization.

14. The polarization control system of claim 5, wherein the plurality of first or second antenna elements are monopole radiators.

15. The polarization control system of claim 5, wherein the plurality of first or second antenna elements are flared notch radiators.

16. The polarization control system of claim 5, wherein the plurality of first and second elements are contiguously arranged in a generally planar fashion, the first and second elements having a predetermined amplitude weighting factor that tapers from a central region to an outer perimeter of the plurality of first and second elements.

17. A method comprising:

adjusting a beam polarization of an antenna array, wherein adjusting the beam polarization of the antenna array comprises:

providing a plurality of first antenna elements having a first direction of polarization and a plurality of second antenna elements having a second direction of polarization, the second direction of polarization being different than the first direction of polarization;

attenuating an amplitude of an electro-magnetic wave produced by the plurality of first antenna elements by adjusting the amplitude of a first subset of the plurality of the first antenna elements; and producing an electro-magnetic wave by the plurality of first and second antenna elements that generally approximates the beam polarization by adjusting a phase shift of a second subset of the plurality of the second antenna elements.

18. The method of claim 17, wherein the act of producing an electro-magnetic wave by the plurality of first and second antenna elements that generally approximates the beam polarization comprises producing an electro-magnetic wave by the plurality of first and second antenna elements that generally approximates a circular polarized electro-magnetic wave.

19. The method of claim 17, further comprising:

wherein the act of providing a plurality of first and second elements further comprises providing a plurality of first and second elements that are contiguously arranged on a generally flat surface; and tapering the amplitude of the signal from a central region to an outermost region of the plurality of first and second elements.

20. The method of claim 17, further comprising maintaining the phase of the first subset of the plurality of first antenna elements at a relatively constant level.

21. The method of claim 17, further comprising maintaining the amplitude of the second subset of the plurality of second antenna elements at a relatively constant level.

22. A method for adjusting a beam polarization of an antenna array comprising:

providing a plurality of first antenna elements having a first direction of polarization and a plurality of second antenna elements having a second direction of polarization, the second direction of polarization being different than the first direction of polarization;

attenuating an amplitude of an electro-magnetic wave produced by the plurality of first antenna elements by adjusting the amplitude of a first subset of the plurality of the first antenna elements;

producing an electro-magnetic wave by the plurality of first and second antenna elements that generally approximates the beam polarization by adjusting a phase shift of a second subset of the plurality of the second antenna elements; and maintaining the phase of the first subset of the plurality of first antenna elements at a relatively constant level.

23. A method for adjusting a beam polarization of an antenna array comprising:

providing a plurality of first antenna elements having a first direction of polarization and a plurality of second antenna elements having a second direction of polarization, the second direction of polarization being different than the first direction of polarization:

attenuating an amplitude of an electro-magnetic wave produced by the plurality of first antenna elements by adjusting the amplitude of a first subset of the plurality of the first antenna elements;

producing an electro-magnetic wave by the plurality of first and second antenna elements that generally approximates the beam polarization by adjusting a phase shift of a second subset of the plurality of the second antenna elements; and maintaining the amplitude of the second subset of the plurality of second antenna elements at a relatively constant level.

* * * * *